United States Patent [19]

Gilb

[11] 4,104,843

[45] Aug. 8, 1978

[54] HANGER ADJUSTABLE END BEARING ASSEMBLY

[75] Inventor: Tyrell T. Gilb, Berkeley, Calif.

[73] Assignee: Simpson Manufacturing Co., Inc., San Leandro, Calif.

[21] Appl. No.: 828,544

[22] Filed: Aug. 29, 1977

[51] Int. Cl.[2] ..... E04C 3/02

[52] U.S. Cl. ..... 52/693

[58] Field of Search ..... 52/650, 693, 262, 692, 52/696; 403/217, 384, 404

[56] References Cited

U.S. PATENT DOCUMENTS

| | | | |
|---|---|---|---|
| 3,268,251 | 8/1966 | Troutner | 52/650 |
| 3,330,087 | 7/1967 | Troutner | 52/693 |
| 3,961,455 | 6/1976 | Peters | 52/693 |

*Primary Examiner*—John E. Murtagh

*Attorney, Agent, or Firm*—James R. Cypher

[57] ABSTRACT

A hanger for light series composite trusses having a single upper wood chord and a single lower wood chord joined by a plurality of metal web members by pins. The hanger consists of a pair of mirror image members fabricated from flat sheet metal using standard continuous die, punch-press operations. Each hanger member consists of a horizontal portion and two vertical portions; all at right angles to one another, a tab member and an opening for receiving the truss joint pin.

4 Claims, 15 Drawing Figures

HANGER ADJUSTABLE END BEARING ASSEMBLY

BACKGROUND OF THE INVENTION

The early light series composite trusses, such as Troutner U.S. Pat. Nos. 3,137,899, (1964) and Troutner 3,268,251 (1966) were designed so that either the top or bottom chord rested on top of the end bearing wall or other horizontal support. Where it was desired to hang the truss from the side of the support wall or horizontal support, special expensive, custom made hangers were fabricated. Because of the weight and cost of such hangers, they were seldom used even though there was a great need for hanger supported trusses.

In 1974, Gilb was granted a patent on an improved composite truss, but it also required the same expensive custom made hanger.

The first integral design for hanging light series composite trusses was presented by Peters in U.S. Pat. No. 3,961,455 (1976). Peters described several solutions, all of which required a welded bracket and a long strengthening bar spanning the distance between two pin joints. The metal strengthening bar either consists of a heavy channel member which envelopes three sides of the upper chord or requires a long center slot in the upper chord.

While a practical method of hanging light series trusses remained unsolved, Gilb found an economical means for hanging medium and heavy load series composite trusses which have double timber members in the top chord, see Gilb, U.S. Pat. No. 4,003,179 (1977). These hangers, however, were unsuitable for light series trusses having single timber members in the chords.

Finally, it is well known that where the trusses must span 12 to about 60 feet, the bearing walls cannot be built to zero tolerance. The Peters patent does not disclose any adjustment in the hanger to compensate for the misalignment of the bearing walls.

SUMMARY OF THE DISCLOSURE

The key to the success of the present invention is the provision of an improved joint assembly such as the one described in Gilb, U.S. Ser. No. 758,061, filed Jan. 10, 1977 now U.S. Pat. No. 4,069,635. In this joint assembly, the high shear loads and moment forces are largely transferred from the metal webs and through the metal pins to a metal connector assembly which distributes the loads to the wood chords. The essence of the present invention, for hanging the composite trusses, is the use of mirror image hanger members fabricated from sheet metal which transfer most of the truss loads through the pin to the hanger members rather than from the wood chords to the hanger members. In this way, the load transfer is primarily through metal to metal contact, rather than wood to metal contact.

A primary object of the present invention is to provide an integral end joint and hanger assembly which requires no welded joints.

A further object is to provide an adjustable hanger end bearing assembly to compensate for alignment errors in constructing the bearing walls.

Still another object is to provide an assembly which is less expensive to manufacture, can be preassembled either at the factory or at the job site and provides easy installation of the trusses at the job site.

A further object is to provide an integral hanger joint as described which requires no additional truss strengthening members which must be glued, bolted or otherwise fastened to the wood chords.

Still another object is to provide an integral hanger joint which requires a minimum of wood removal from the chord member.

DESCRIPTION OF THE PREFERRED EMBODIMENTS OF THE INVENTION

Figure 1:
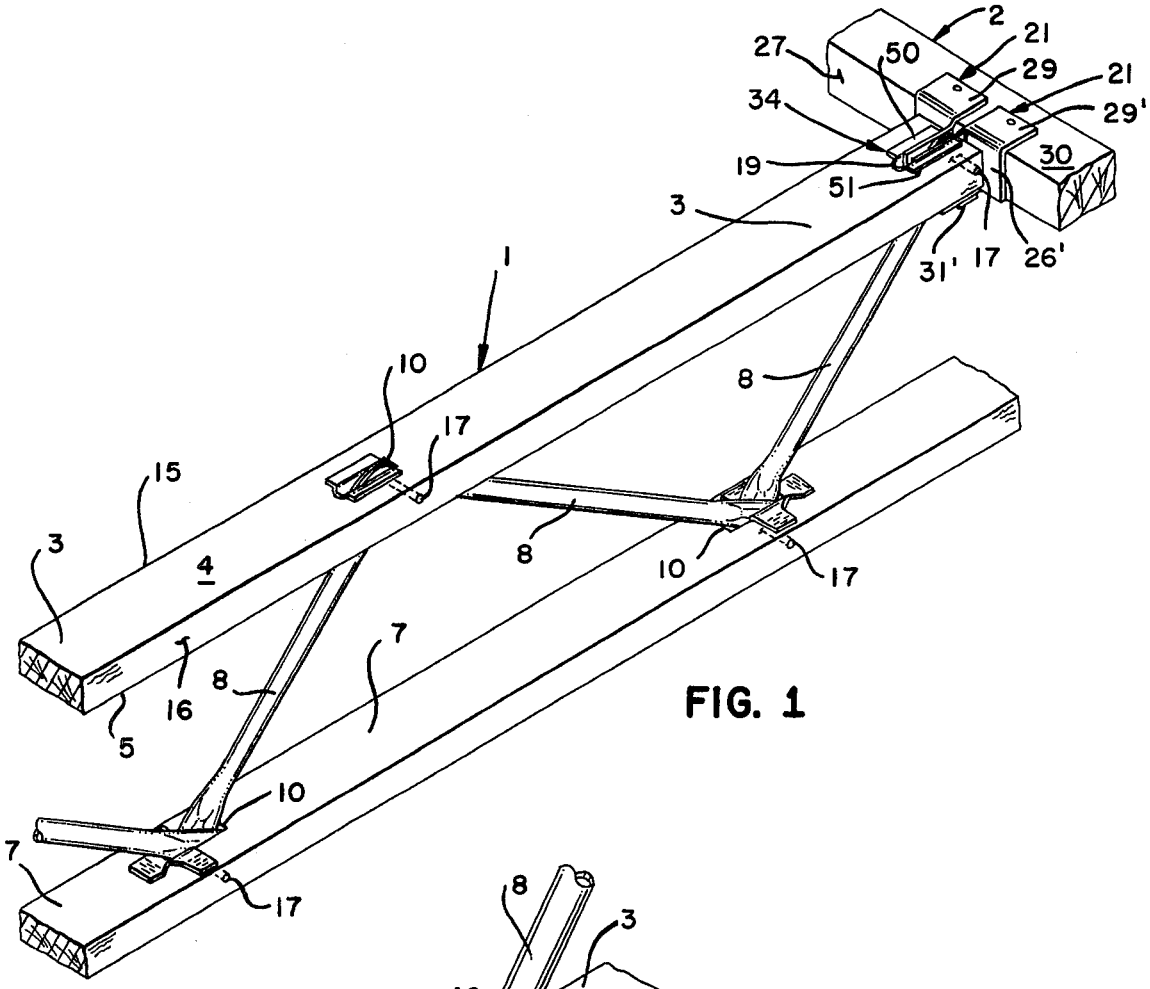
FIG. 1 is a perspective view of a light load series composite truss connected to an end bearing wall by an adjustable hanger end bearing assembly constructed in accordance with the present invention.
Figure 2:
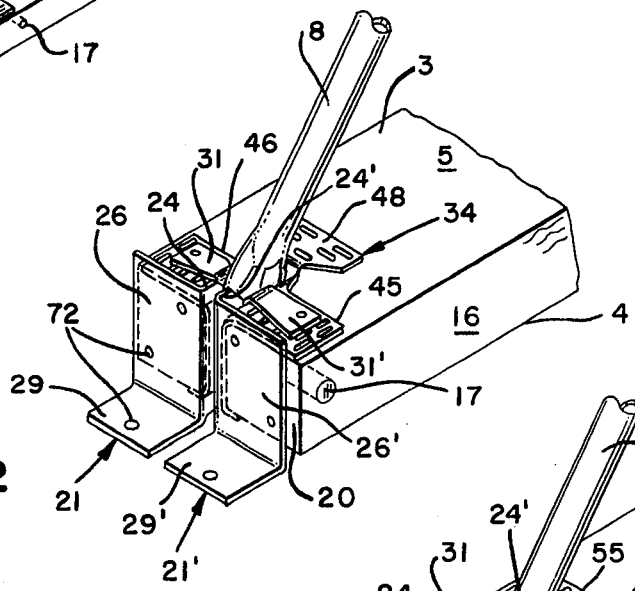
FIG. 2 is a perspective view of the assembly of FIG. 1 as viewed from the underside and attached to a top chord. The chord section has been rotated 180°.
Figure 3:
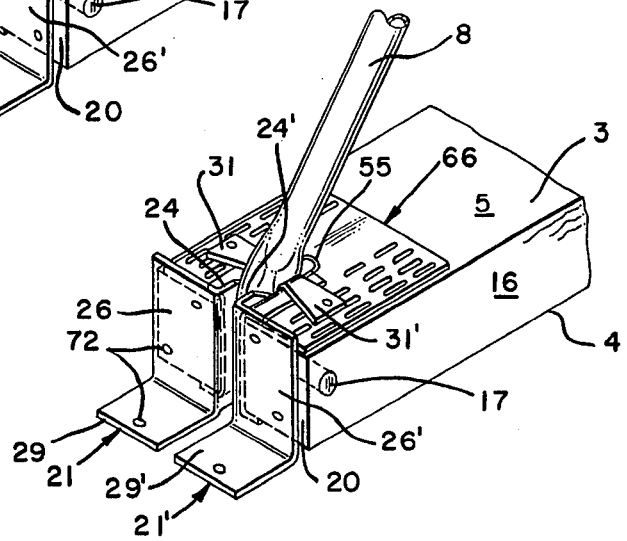
FIG. 3 is a perspective view of another hanger assembly as illustrated in FIGS 13–15 as viewed from the underside and attached to a top chord. The chord section has been rotated 180°.
Figure 4:
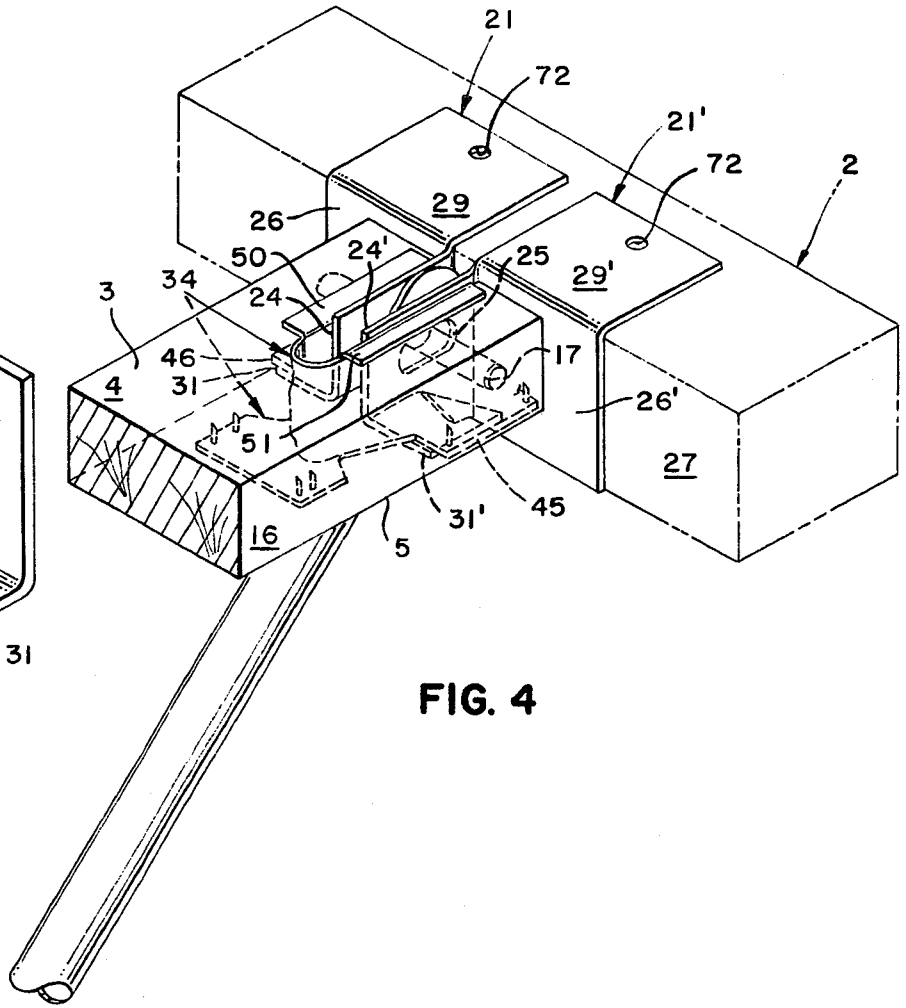
FIG. 4 is an enlarged perspective view of the end bearing assembly shown in FIG. 1.
Figure 5:
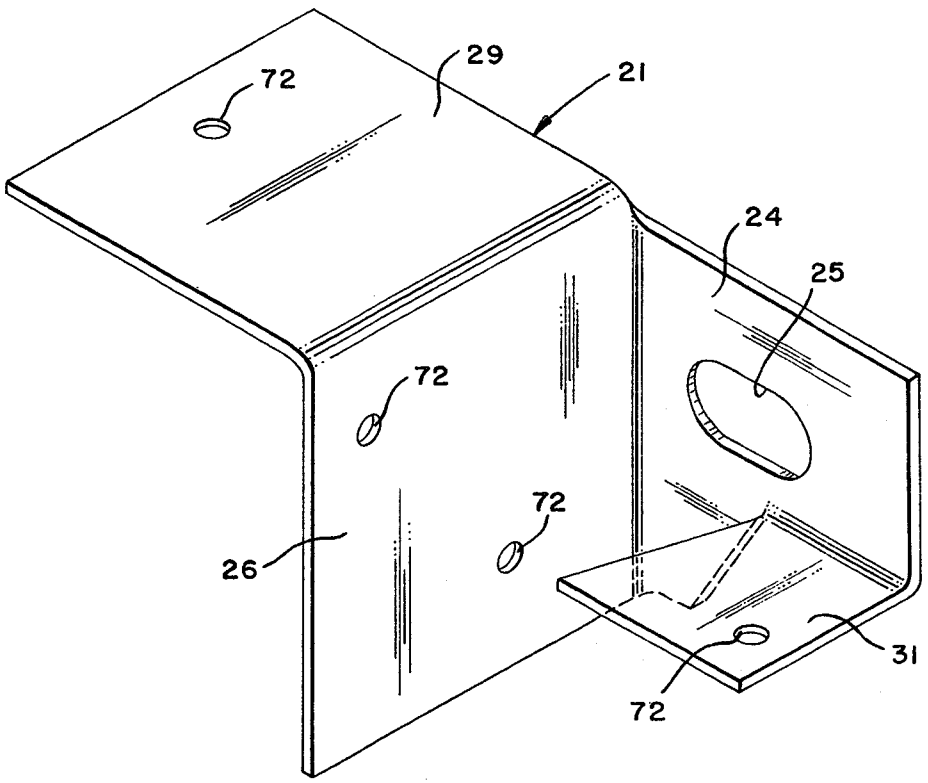
FIG. 5 is an enlarged perspective view of one of the mirror image members used in the hanger end bearing assemblies of all of the forms of the invention illustrated.

The hanger end bearing assembly of the present invention is used in connecting the end of a composite light series truss 1 to an end support 2. These trusses include a top chord 3 which consists of a single lumber member having upper and lower faces 4 and 5, a lower chord 7, a plurality of metal web members 8 extending between the upper and lower chords with each web having an opening 9 formed in their ends. The upper chord is formed with a plurality of slots 10 spaced along the length thereof which extend through the lower face of the upper chord. The chord is formed with a plurality of cross bores 12 which extend from the inner faces 13 and 14 of the slots, outwardly toward the chord edges 15 and 16. A plurality of elongated pin members 17 dimensioned for extending through the opening in the web members and into the cross bores in the chords connect the webs to the chords. The end slots 19 in the upper chord extend to the end 20 of the top chord. The hanger assembly consists of a pair of sheet metal members 21 and 21' placed in side by side relation. Each member is the mirror image of the other and both are constructed from the same sheet metal blank. The folds in the sheet metal are merely bent in different directions to construct the mirror image members.

Each member has a generally planar side member 24 and 24' which is mounted substantially vertically and extends into the end slots 19 in the chord. The side member is formed with an opening 25 therethrough for registration with the cross bore in the chord and for receipt of pin 17. A back flange 26 and 26' is integrally connected to substantially the entire length of each of the side members and is positioned at a generally right angle to the side member and is adapted for connection to the side face 27 of the end support 2. A top flange 29 is integrally connected to substantially the entire length of the back flange and is positioned at a generally right angle to the back flange and the side member. The top flange is adapted for connection to the top face 30 of the end support 2. Additional support for the truss and rigidity of the side member may be provided by a tab member 31 which is integrally connected to the side member 24 and is positioned at right angles thereto and parallel to the top flange 29. The tab member is adapted to support the inside or lower face 5 of the top chord member.

Since it is virturally impossible to construct buildings walls to zero tolerance, a commercially successful hanger must have the ability to compensate for a certain amount of misalignment of bearing walls. In the present invention, this adjustment feature is provided by forming the opening 25 in the side member in an elongated form in a direction parallel to the longitudinal axis of the truss. Thus the hanger member can be firmly anchored to the bearing wall by nails, screws, bolts or other suitable fasteners and whatever misalignment there is in the walls will be compensated for in the attachment of the connector pin in the elongated slot.

Figure 11:
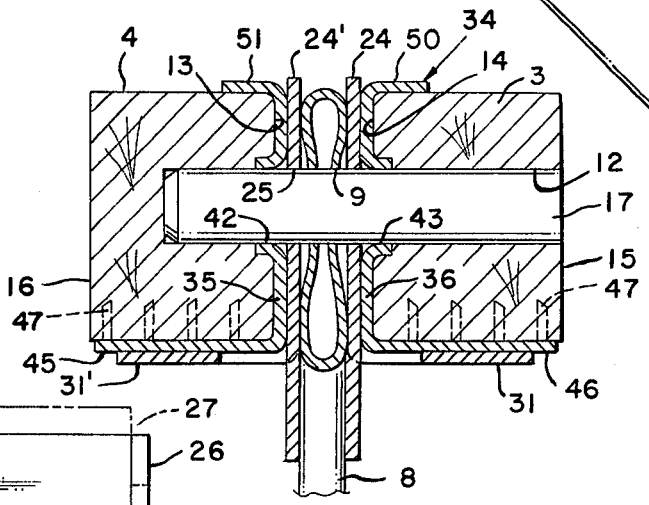
FIG. 11 is a cross sectional view taken along line 11—11 of FIG. 10.
Figure 12:
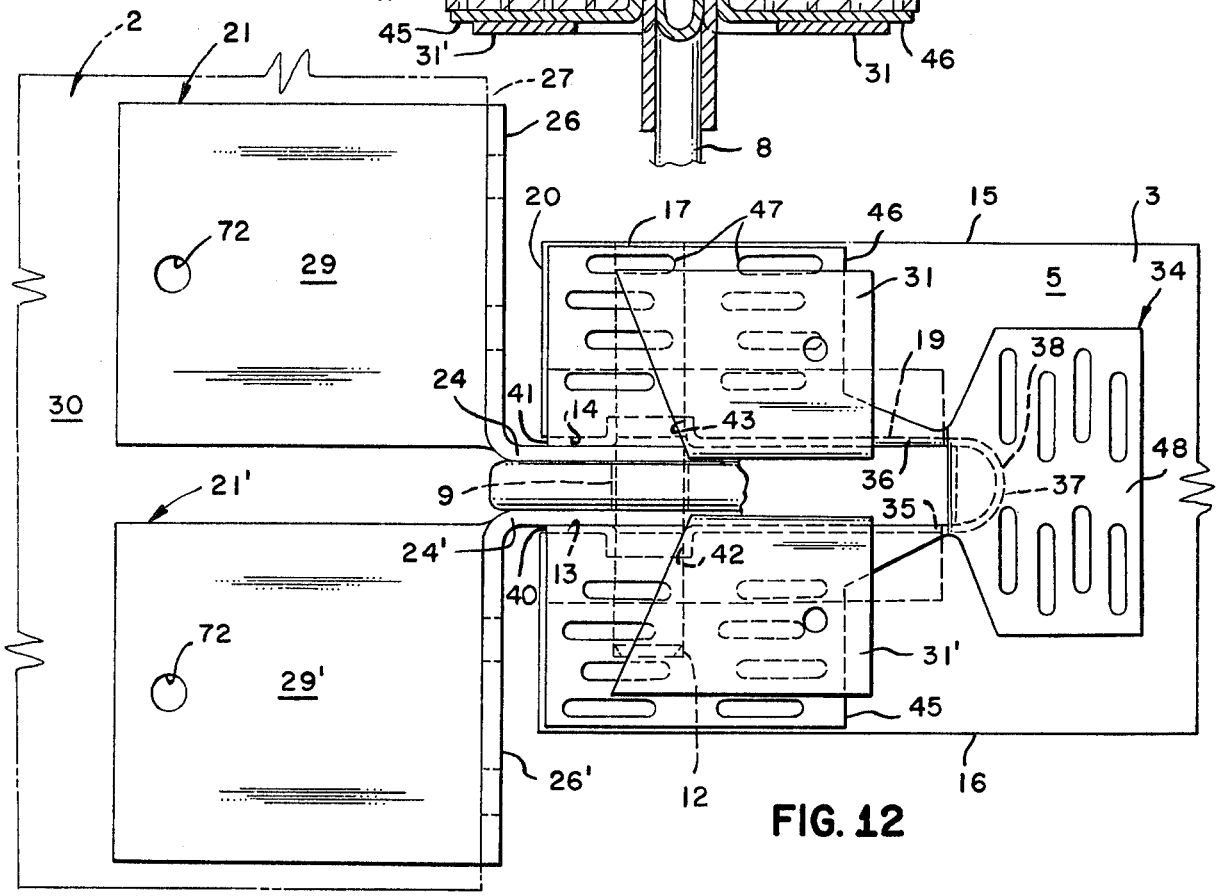
FIG. 12 is a bottom plan view of the assembly shown in FIG. 10.
Figure 13:
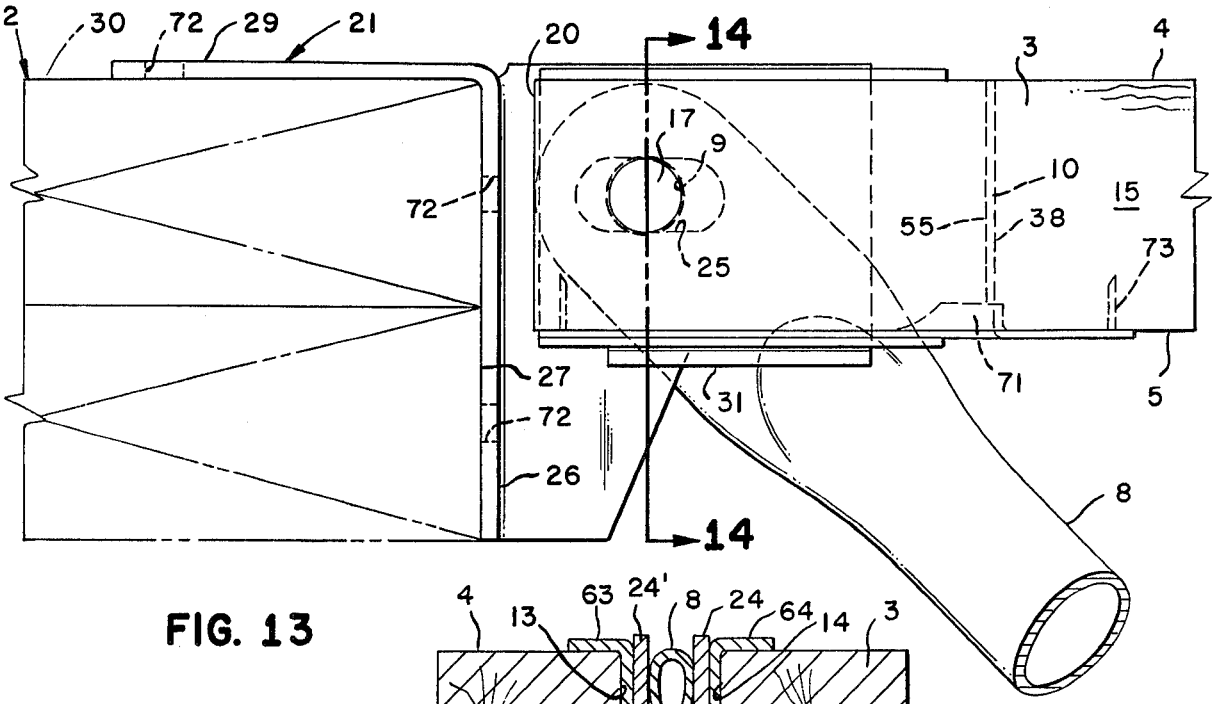
FIG. 13 is a side elevation view of another assembly illustrated in FIG. 3.

The hanger end bearing assembly is preferably used in combination with a clevis assembly truss joint which is fully described in Gilb, U.S. patent application, Ser. No. 758,061 filed Jan. 10, 1977. The preferred form of clevis assembly joint is illustrated in FIGS. 1, 2, 10, 11 and 12. Referring to these figures, the hanger end bearing assembly comprises a clevis member 34 positioned in each of the end slots and includes a first and second leg member 35 and 36 integrally joined at one end by an end portion 37. The end portion is positioned in close fitting abutment with the end 38 of slot 19. The leg members have distal ends 40 and 41 which are not attached to each other and are therefore free for lateral movement. Openings 42 and 43 are formed in leg members for registration with the cross bores 12 in the chord. Inside face flanges 45 and 46 are integrally connected at right angles to the inner edges of the clevis legs 35 and 36 and are adapted for engagement with the inner face 5 of the top chord. Prongs 47 attach the inside face flanges to the inner face 5 of the top chord. An end flange 48 is integrally connected to the inner edge of the legs and at right angles to the end portion. Prongs 47 attach the end flange to the inner face of the top chord. Outside face flanges 50 and 51 are integrally connected at right angles to the legs and are adapted for engaging the outer face of the top chord. As shown in FIG. 11, side members 24 and 24' are positioned inside legs 35 and 36 of the clevis member. Note that the transfer of load from the web member 9 is through metal pin 17 to metal side members 24 and 24' of the hanger members. Further, load from the wood chord 3 is through metal clevis legs 35 and 36, through metal pin 17 and thence to hanger side member 24 and 24'.

Figure 14:
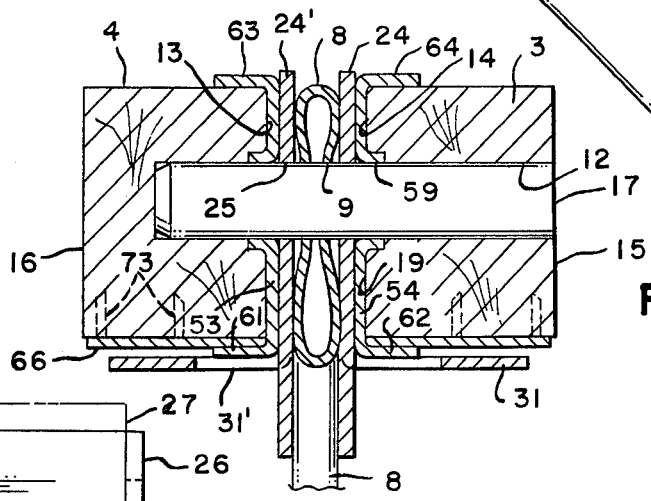
FIG. 14 is a cross sectional view taken along line 14—14 of FIG. 13.
Figure 15:
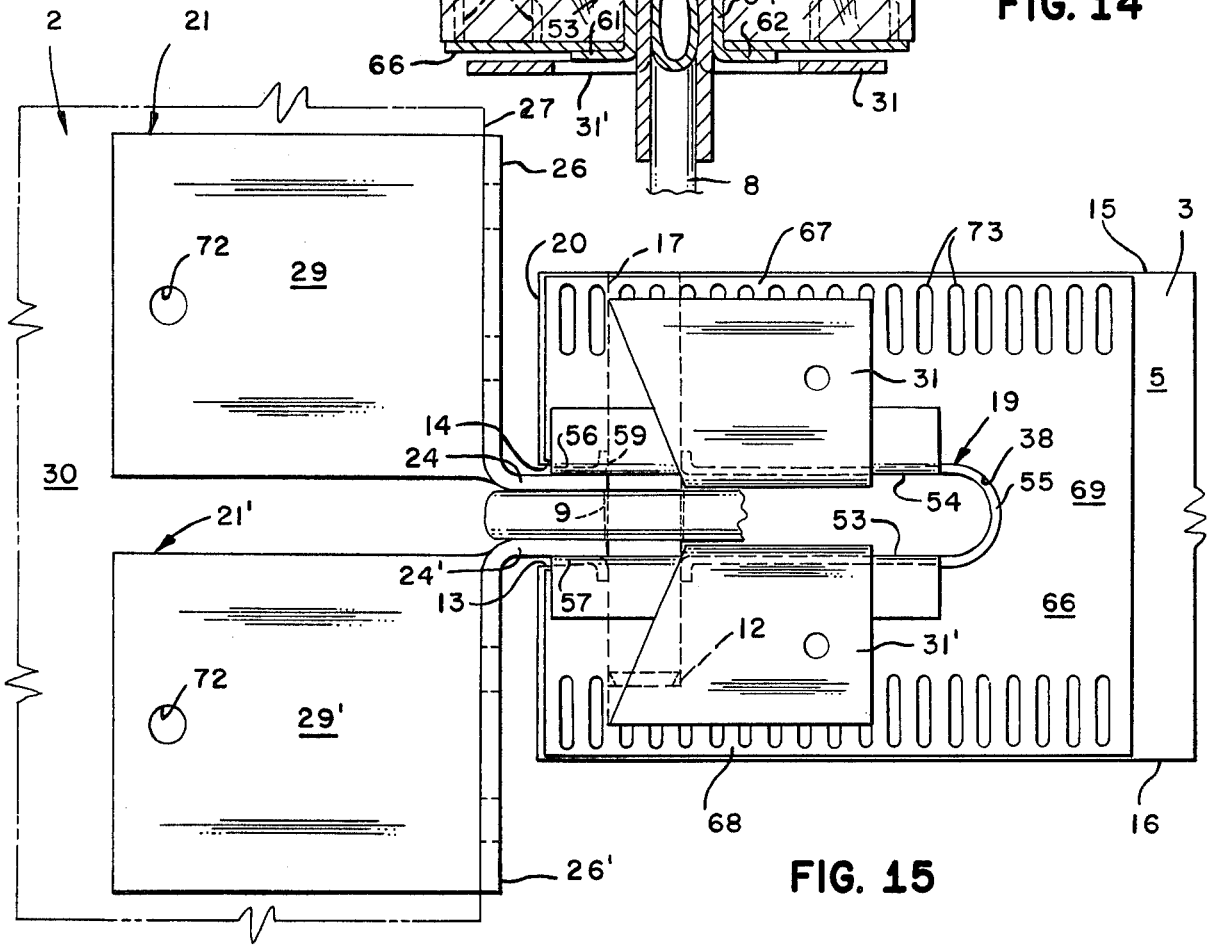
FIG. 15 is a bottom plan view of the assembly illustrated in FIG. 13.

Another form of the invention is illustrated in FIGS. 3, 13, 14 and 15 of the drawings. The clevis joint is formed with two members instead of the single member previously described. The clevis members are positioned in each of the end slots and each joint is formed with first and second leg members 53 and 54 integrally joined at one end by an end portion 55 adapted for close fitting abutment with the ends 38 of each of the end slots 19. The distal ends 56 and 57 are free for lateral movement. Openings 59 are formed in each of the leg members and are positioned in alignment with the cross bores 12. The inside face flanges 61 and 62 are integrally connected at right angles to the inner edges of the legs. Outside face flanges 63 and 64 are integrally connected at right angles to the legs and are adapted for attachment to the outside face 4 of the top chord. An inner plate member 66 is adapted for attachment to the inside face of the top chord and has arms 67 and 68 bordering a substantial portion of each side of the slot. A cross portion 69 borders one end of the slot and has an outwardly drawn tongue 71 depending into the end of the slot. The end portion of the clevis is positioned to engage the inner plate tongue, and the inner face flanges of the clevis are positioned in engagement with the top face 4 of the top plate member. As best illustrated in FIG. 14, side member 24 and 24' are spaced on either side of the end of web member 8 and between clevis leg members 53 and 54. Tab members 31 and 31' are in contact with inside face flanges 61 and 62. Loads from web 8 are transferred to side members 24 and 24' through pin 17. Loads from the chord are transferred to side members 24 and 24' through clevis leg members 53 and 54 through metal pin 17. Thus transfer of loads from the chord to the hanger is by metal to metal contact.

The clevis joint assembly and hanger assembly may be assembled at the factory and shipped to the job site. The truss is then set on the bearing wall. Workmen at the job site merely position the truss and fasten the hanger assembly to the end bearing member using the pre-punch openings 72 in the top flange and back flange.

Prongs 73 may be used to attach the clevis plate member to the wood chord.

Figure 7:
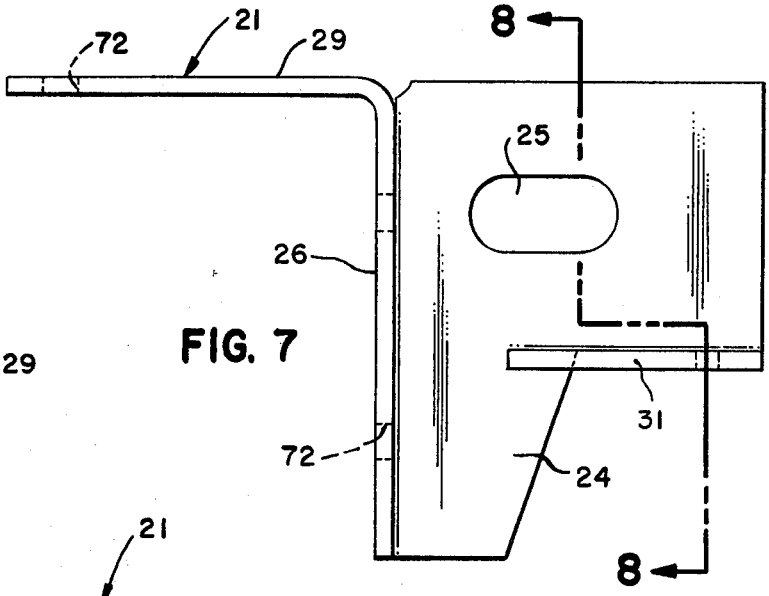
FIG. 7 is a side elevation view of the member shown in FIG. 6 after it has been bent to its final form.
Figure 6:
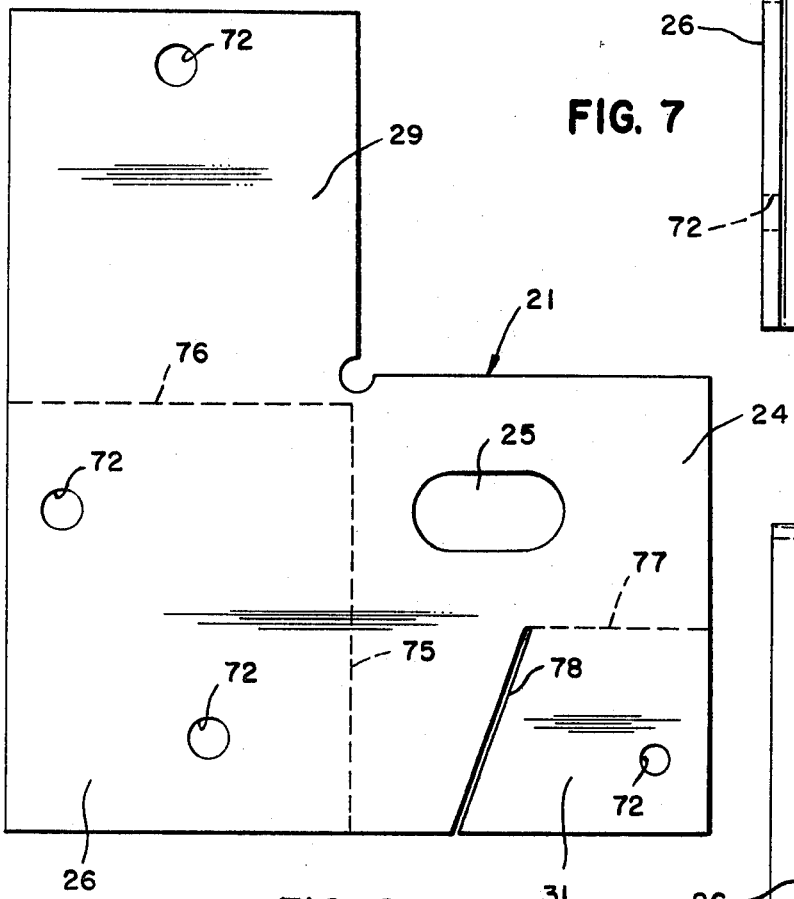
FIG. 6 is a plan view of the member shown in FIG. 5 prior to bending.
Figure 8:
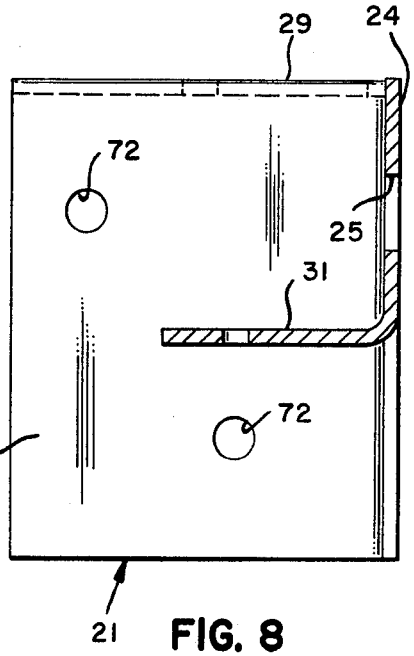
FIG. 8 is a cross sectional view taken along lines 8—8 of FIG. 7.
Figure 9:
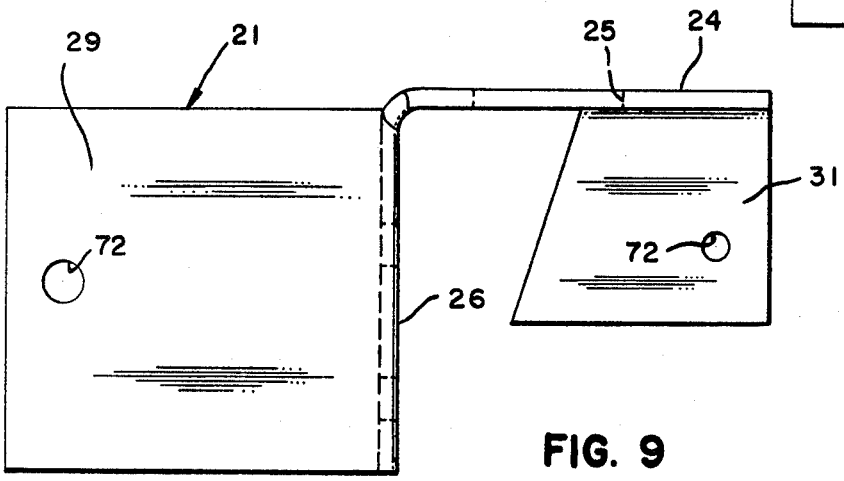
FIG. 9 is a top plan view of the member shown in FIG. 7.
Figure 10:
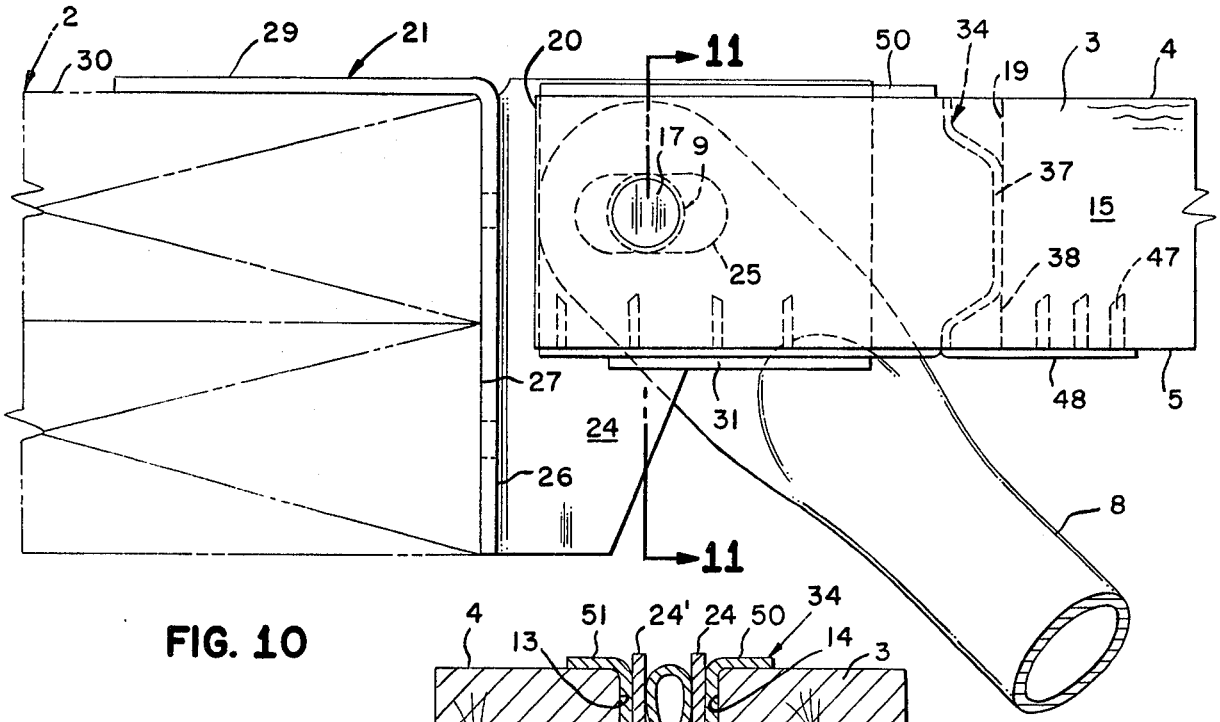
FIG. 10 is a side elevation view of the hanger end bearing assembly shown in FIGS. 1, 2 and 4.

A unique feature of the invention is the fact that both hanger members 21 and 21' may be made from the identical hanger blank as shown in FIG. 6. Folding along lines 75, 76, and 77 in the manner illustrated in FIGS. 7–9 creates the hanger member 21. Folding along lines 75, 76, and 77 in the opposite direction creates the hanger member 21'.

Still another unique feature is the fact that the widths of side member 24 and top flange 29 are identical. This fact makes it possible to cut out the blanks on a progressive die from a strip of metal without any waste metal. A slot 78 is cut in the side member to create the tab 31.

I claim:

1. A hanger end bearing assembly for connecting the end of a composite light series truss to an end support; said truss includes a top chord consisting of a single lumber member having upper and lower faces; a lower chord, a plurality of metal web members extending between said upper and lower chords each having an opening formed in their ends; said upper chord is formed with a plurality of slots spaced along the length thereof which extend through said lower face; said chord is formed with a plurality of cross bores extending from the inner faces of said slots outwardly toward said chord edges; and a plurality of elongated pin members dimensioned for extending through said openings in said web members, and into said cross bores in said chords; said hanger assembly comprising:

a. the end slots in said upper chord extend to the ends of said top chord;

b. a pair of sheet metal members placed in side by side relation each having:

1. a generally planar side member mounted substantially vertically and extending into said end slots and formed with an opening therethrough for registration with said cross bores in said chord for receipt of said pin;

2. a back flange integrally connected to substantially the entire length of said side member and positioned at a generally right angle to said side member and adapted for connection to said end support;

3. a top flange integrally connected to substantially the entire length of said back flange and positioned at a generally right angle to said back flange and side member and adapted for connection to said end support; and c. each of said pair of sheet metal members is formed with a tab member integrally connected to said side member and positioned at right angles thereto and parallel to said top member.

2. A hanger end bearing assembly as described in claim 1 comprising:

a. said opening in each of said side members is elongated in a direction parallel to the longitudinal axis of said truss providing an adjustment for receiving the end of said truss when said end support is out of alignment.

3. A hanger end bearing assembly as described in claim 1 comprising:

a. a clevis member positioned in each of said end slots having first and second leg members integrally joined at one end by an end portion; said end portion is positioned in close fitting abutment with the end of said slot, and said leg members have distal ends which are not attached to each other and are therefore free for lateral movement, openings formed in said leg members in registration with said cross bores in said chord, inside face flanges integrally connected at right angles to the inner edges of said legs and adapted for engagement with the inner face of said top chord; prong means attaching said inside face flanges to said inner face of said top chord, an end flange integrally connected to the inner edge of said legs and at right angles to said end portion and formed with prongs for engagement with the inner face of said top chord; outside face flanges integrally connected at right angles to said legs and adapted for engaging the outer face of said top chord; and b. said opening in each of said side members is elongated in a direction parallel to the longitudinal axis of said truss providing an adjustment for receiving the end of said truss when said end support is out of alignment.

4. A hanger end bearing assembly as described in claim 1 comprising:

a. a clevis member positioned in each of said end slots having first and second leg members integrally joined at one end by an end portion adapted for close fitting abutment with the ends of said end slots and said leg members have distal ends which are not attached to each other and are therefore free for lateral movement, openings formed in each of said leg members positioned in alignment with said cross bores; inside face flanges integrally connected at right angles to the inner edges of said legs, outside face flanges integrally connected at right angles to said legs and adapted for engaging the outer face of said top chord, an inner plate member adapted for attachment to the inside face of said top chord and having arms bordering a substantial portion of each side of said slot and having a cross portion bordering one end of said slot and having an outwardly drawn tongue depending into the end of said slot, said end portion of said clevis is positioned to engage said inner plate tongue and said inner face flanges of said clevis are positioned in engagement with the top face of said top plate member; and b. said opening in each of said side members is elongated in a direction parallel to the longitudinal axis of said truss providing an adjustment for receiving the end of said truss when said end support is out of alignment.

* * * * *